US009119468B2

(12) United States Patent
Mensa'

(10) Patent No.: US 9,119,468 B2
(45) Date of Patent: Sep. 1, 2015

(54) DRAWER WITH FRONT DOOR PROVIDED WITH LOCKING-REGULATING APPARATUS OF SAID FRONT DOOR

(71) Applicant: ESSETRE S.R.L., Cagli (IT)

(72) Inventor: Stefano Mensa', Cagli (IT)

(73) Assignee: ESSETRE S.R.L., Cagli (PS) (IT)

( * ) Notice: Subject to any disclaimer, the term of this patent is extended or adjusted under 35 U.S.C. 154(b) by 0 days.

(21) Appl. No.: 14/352,564

(22) PCT Filed: Oct. 24, 2012

(86) PCT No.: PCT/EP2012/071021

§ 371 (c)(1),
(2) Date: Apr. 17, 2014

(87) PCT Pub. No.: WO2013/060709

PCT Pub. Date: May 2, 2013

(65) Prior Publication Data

US 2014/0239787 A1 Aug. 28, 2014

(30) Foreign Application Priority Data

Oct. 26, 2011 (IT) ..... MC2011A0058

(51) Int. Cl.
*A47B 88/00* (2006.01)

(52) U.S. Cl.
CPC ..... *A47B 88/0055* (2013.01); *A47B 2088/007* (2013.01)

(58) Field of Classification Search
CPC ..... A47B 88/0055
USPC ..... 312/330.1, 348.2, 348.4, 348.1; 292/17
See application file for complete search history.

(56) References Cited

U.S. PATENT DOCUMENTS

| | | | | |
|---|---|---|---|---|
| 1,199,014 | A * | 9/1916 | Ludeke | 24/611 |
| 4,902,080 | A * | 2/1990 | Berger | 312/348.4 |
| 4,995,683 | A * | 2/1991 | Albiez | 312/348.4 |
| 5,002,346 | A * | 3/1991 | Gasser | 312/348.4 |
| 5,647,618 | A | 7/1997 | Lamberth | |
| 6,378,466 | B1 * | 4/2002 | Oyster et al. | 119/863 |
| 6,981,752 | B2 * | 1/2006 | Harn et al. | 312/348.4 |
| 7,429,090 | B2 * | 9/2008 | Salice | 312/348.4 |
| 8,262,175 | B2 * | 9/2012 | Lam et al. | 312/348.4 |
| 8,585,165 | B2 * | 11/2013 | Liang et al. | 312/334.4 |

FOREIGN PATENT DOCUMENTS

| | | | |
|---|---|---|---|
| DE | 3540788 | A1 * | 7/1986 |
| EP | 0160733 | A1 | 11/1985 |
| EP | 0439748 | A2 | 8/1991 |

OTHER PUBLICATIONS

International Search Report for corresponding International Application No. PCT/EP2012/071021, Jan. 18, 2013.

* cited by examiner

*Primary Examiner* — Matthew Ing
(74) *Attorney, Agent, or Firm* — Egbert Law Offices, PLLC

(57) ABSTRACT

A drawer has a front door and a locking-regulating apparatus of the front door. The apparatus has a first locking-regulating device of the door with respect to the drawer according to the "X" horizontal axis and to the "Y" vertical axis.

11 Claims, 7 Drawing Sheets

DRAWER WITH FRONT DOOR PROVIDED WITH LOCKING-REGULATING APPARATUS OF SAID FRONT DOOR

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to a drawer provided with front door and comprising a locking-regulating apparatus of said front door.

2. Description of Related Art Including Information Disclosed Under 37 CFR 1.97 and 37 CFR 1.98.

More precisely, a drawer with front door is a drawer composed of a horizontal bottom wall and at least one vertical front edge whereon a front door is fixed.

Said front door, also defined as finishing door, remains visible when the drawer is closed, thus covering the compartment where the drawer is contained.

Said front door is often provided with higher height and/or width than the front edge.

The peculiarity of the devices used to couple said door to the drawer is that they permit to regulate the door after positioning the drawer inside the cabinet.

A drawback of the devices that are currently available on the market relates to the complex regulation of the front door with respect to the drawer.

In order to actuate some of said devices, the drawer must be removed from its compartment, whereas other devices do not provide rapid intuitive locking of the door to the drawer, with the negative consequence that the position of the door can accidentally change when during locking.

EP 0 160 733 discloses a drawer provided with regulation device that does not comprise any bracket fixed to the front edge of the drawer.

BRIEF SUMMARY OF THE INVENTION

The main purpose of the present invention is to devise a drawer with front door provided with locking-regulation apparatus, which permits to fix the door to the drawer and then regulate the position of the door with respect to the drawer, without accidentally changing the selection position.

The second purpose of the present invention is to devise a drawer with front door provided with locking-regulation apparatus, which permits to fix the front door to the drawer in centered position according to the "X" and "Y" axes.

The third purpose of the present invention is to devise a drawer with front door provided with locking-regulation apparatus, which permits to mount and fix the front door to the drawer without using the fixing screws that are currently used for such an operation, with the inconvenience that the incorrect insertion of said screws during assembly can cause the uncoupling of the door from the drawer.

The fourth purpose of the present invention is to devise a drawer with front door provided with locking-regulation apparatus, which permits rapid coupling and uncoupling of the front door with respect to the drawer.

The fifth purpose of the present invention is to devise a drawer with front door provided with locking-regulation apparatus, which permits regulation according to the "X" and "Y" axes only after actuating specific regulation means according to the "X" and "Y" axes.

The sixth purpose of the present invention is to devise a drawer with front door provided with locking-regulation apparatus, which permits locking the position of the door with respect to the drawer, after actuating said specific regulation means, without actuating a locking screw (provided in the currently available devices), thus accelerating the regulation cycle.

The seventh purpose of the present invention is to devise a drawer with front door provided with locking-regulation apparatus, which permits to fix the front door to the drawer also when the drawer is already mounted on the runners provided in a cabinet.

In order to achieve the aforesaid purposes, the drawer of the invention is provided with an apparatus comprising at least one locking-regulation device that permits to move the door according to a horizontal "X" axis and a vertical "Y" axis with respect to the drawer.

BRIEF DESCRIPTION OF THE DRAWINGS

The description of the invention continues with reference to the attached drawings, which only have an illustrative, not limiting value, wherein.

DETAILED DESCRIPTION OF THE INVENTION

The drawer (C) of the invention comprises a horizontal bottom wall (F) and a vertical front edge (S) whereon a front door (A) is fixed.

Figure 1:
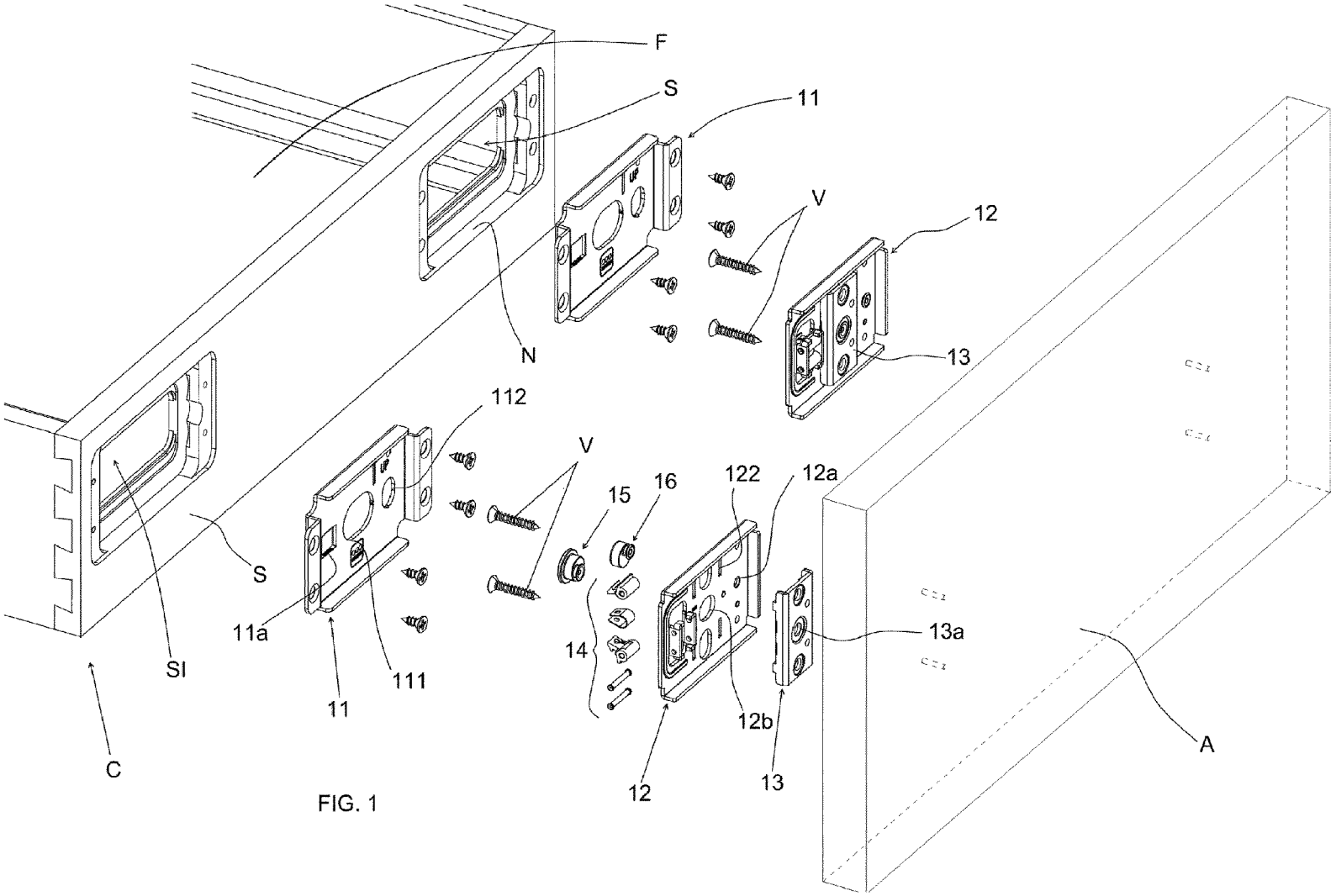
FIG. 1 is an exploded axonometric view of the drawer of the invention provided with locking-regulating apparatus, comprising two identical locking-regulating devices of the front door.
Figure 2:
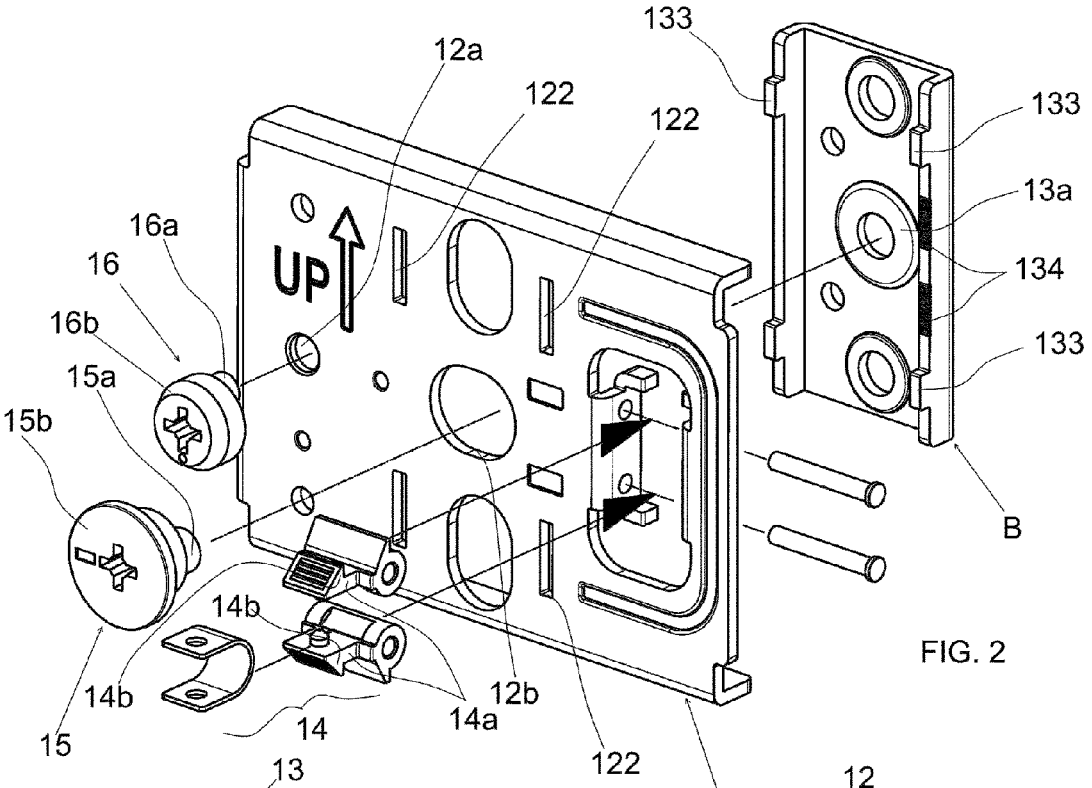
FIGS. 2 and 3 are two exploded axonometric views of the locking-regulating device seen from the front and the back.

Referring to FIG. 1, the apparatus comprises at least one locking-regulating device (1) comprising:

- a bracket (11) frontally fixed to said front edge (S) of drawer (C);
- a cursor (13) fixed on the back of the front door (A);
- a plate (12) fixed to said bracket (11) by means of latch means (14,11*a*); said plate (12) being positioned between said first bracket (11) and said cursor (13).

The device (1) also comprises regulation means (16,12*a*) according to "X" axis and regulation means (12*b*,13*a*,15) according to "Y" axis, as described hereinafter in detail.

Figure 4:
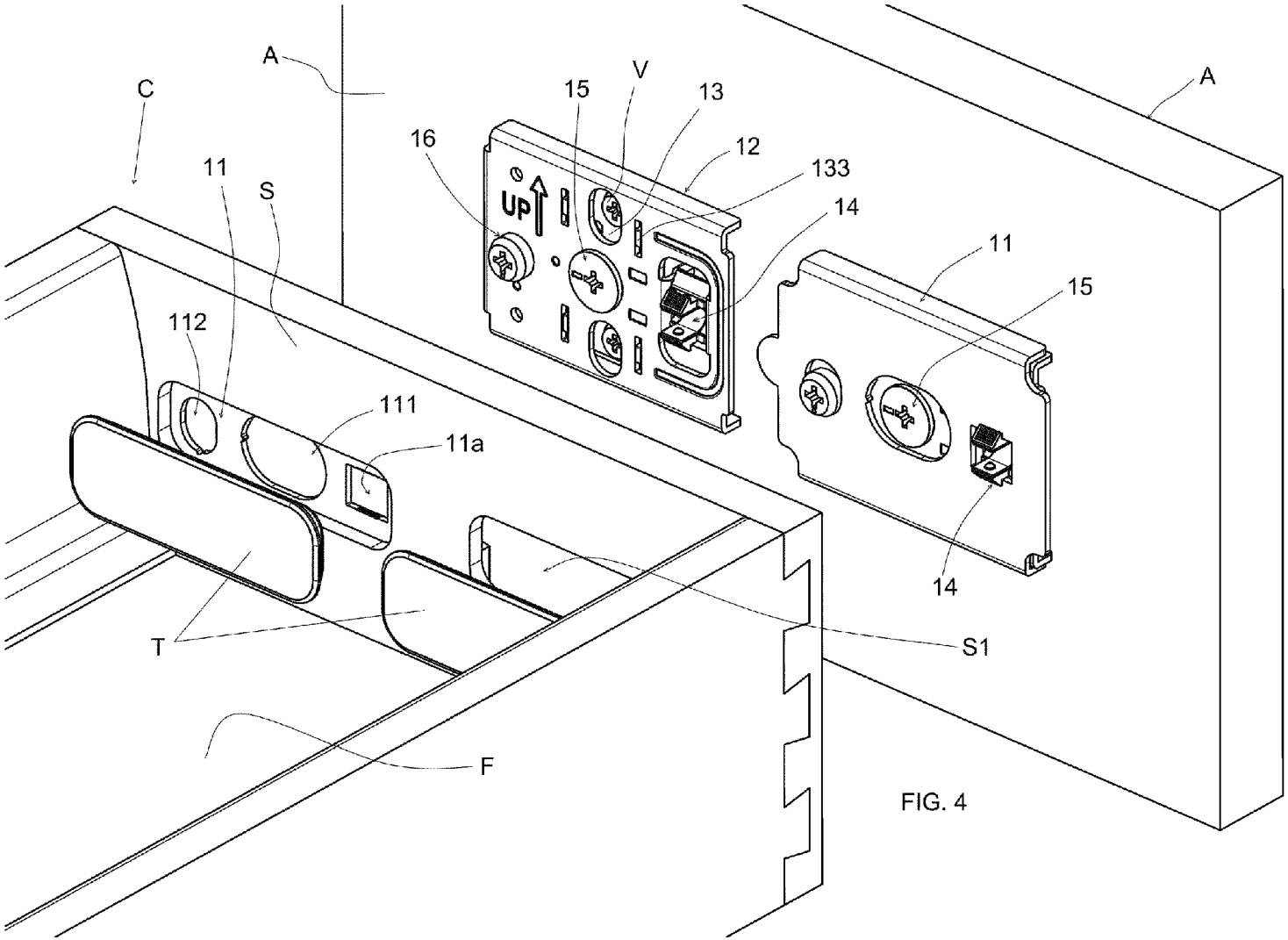
FIG. 4 is an axonometric view of the drawer of the invention with two locking-regulating devices and front door not coupled to the front edge of the drawer.

More precisely, said latch means (14,11*a*) consist in:

- a spring clip (14) provided with a pair of wings (14*a*) with two retention teeth (14*b*) facing outwards, from opposite sides;
- a rectangular slot (11*a*) obtained on said first bracket (11) with horizontal development, as shown in FIG. 4.

The regulation means (16,12*a*) according to "X" axis consist in:

- a regulation screw (16) provided with stem (16*a*) and eccentric enlarged head (16*b*);
- a hole (12*a*) provided on plate (12) housing the stem (16*a*) of said regulation screw (16);
- a vertical slot (112) provided on bracket (11) housing the head (16*b*) of the regulation screw (16).

The operation and advantages of said regulation screw (16) will become clearer after the description below.

Referring to FIG. 1, the assembly of the front door (A) with respect to the front edge (S) of the drawer (C) provides for fixing the bracket (11) with screws (or other fixing systems) to the front edge (S), coupling said cursor (13) and plate (12) and fixing them on the back of the door (A) with screws (V) (or other fixing systems) inserted into suitable holes provided on the cursor (13).

In order to fix the front door (A) to the front edge (S), the spring clip (14) is inserted, making the pair of wings (14*a*) elastically snap inside said rectangular slot (11*a*) (where it can only slide according to "X" axis).

As shown in the attached drawings, said rectangular slot (11*a*) is provided with knurled profile on lower and upper overlapped sides to increase grip between contact surfaces, and precisely between said overlapped sides of the rectangular slot (11*a*) and the external surface of the pair of wings (14*a*); such a technical device is provided in order to guarantee mutual locking between said plate (12) and bracket (11) according to "X" axis, preventing free rightward and leftward sliding of the spring clip (14) inside the rectangular slot (11*a*).

The regulation screw (16) must be actuated in order to regulate the position of the spring clip (14) inside the rectangular slot (11*a*), as described hereinafter in detail.

The regulation means (12*b*, 13*a*, 15) according to "Y" axis between said first cursor (13) and first plate (12) consist in:

- an eccentric screw (15) provided with stem (15*a*) and eccentric enlarged head (15*b*);
- a hole (13*a*) obtained on cursor (13) where stem (15*a*) is inserted;
- a through hole (12*b*) obtained on said first plate (12) housing said eccentric enlarged head (15*b*).

It must be noted that plate (12) and cursor (13) are respectively provided with vertical guide means, consisting in:

- vertical slots (122) provided on the plate (12);
- teeth (133) provided on cursor (13), which are housed inside said vertical slots (122), sliding along "Y" vertical axis.

Figure 5B:
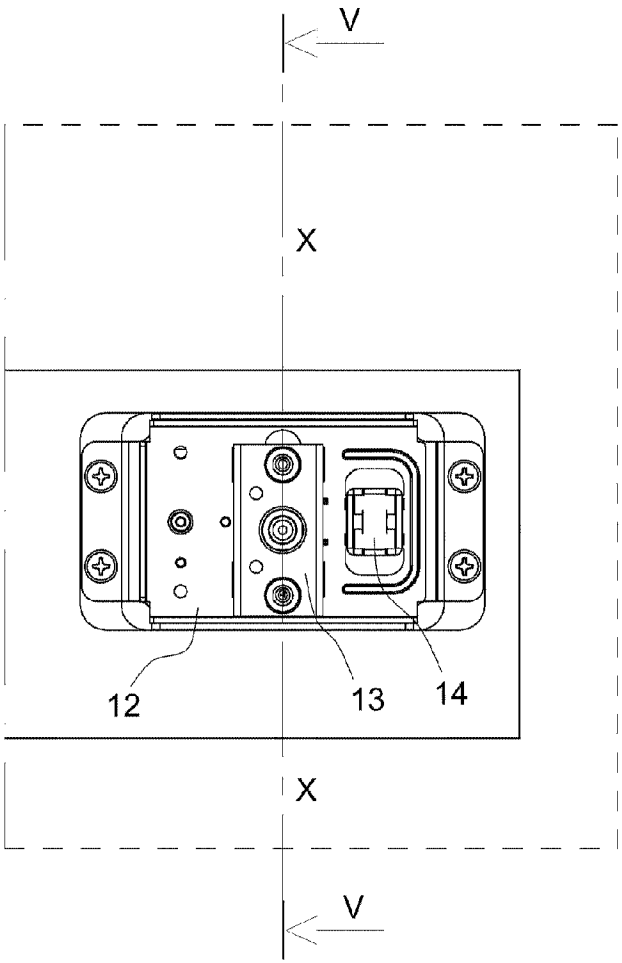
FIGS. 5 and 5B show the locking-regulating device mounted on the drawer of the invention, respectively seen from the inside and the outside, with front door situated at lower end-of-travel position.
Figure 5A:
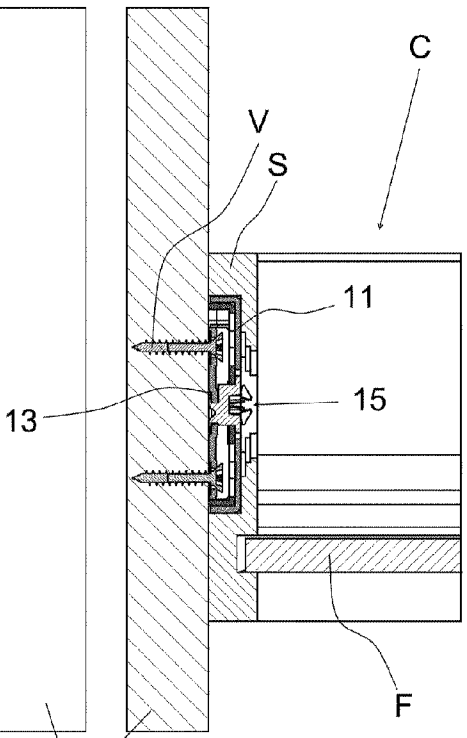
FIG. 5A is a sectional view of FIG. 5B with plane V-V.
Figure 5:
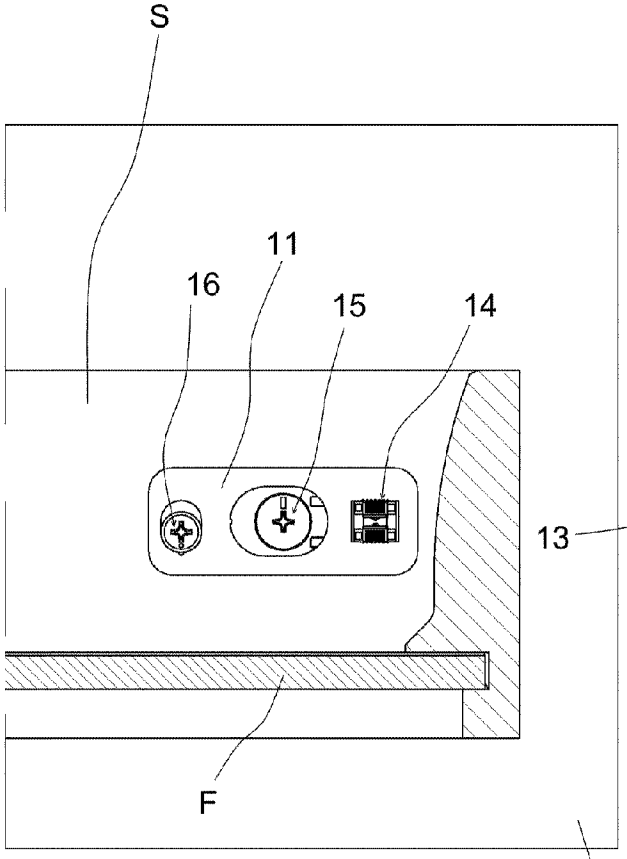
Figure 6B:
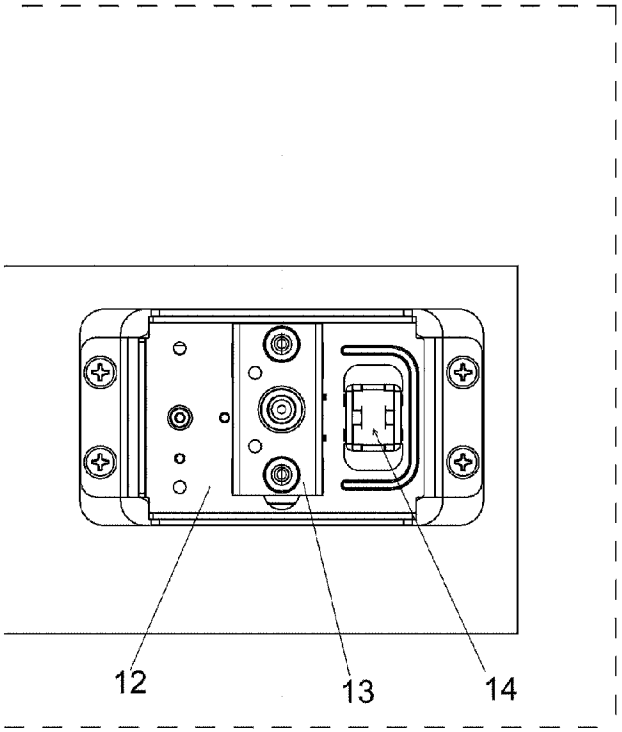
FIGS. 6 and 6B show the locking-regulating device mounted on the drawer of the invention, respectively seen from the inside and the outside, with front door situated at upper end-of-travel position.
Figure 6A:
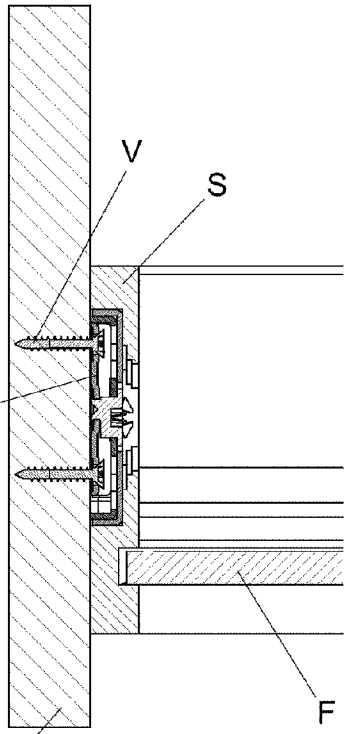
FIG. 6A is a sectional view of FIG. 6B with plane VI-VI.
Figure 6:
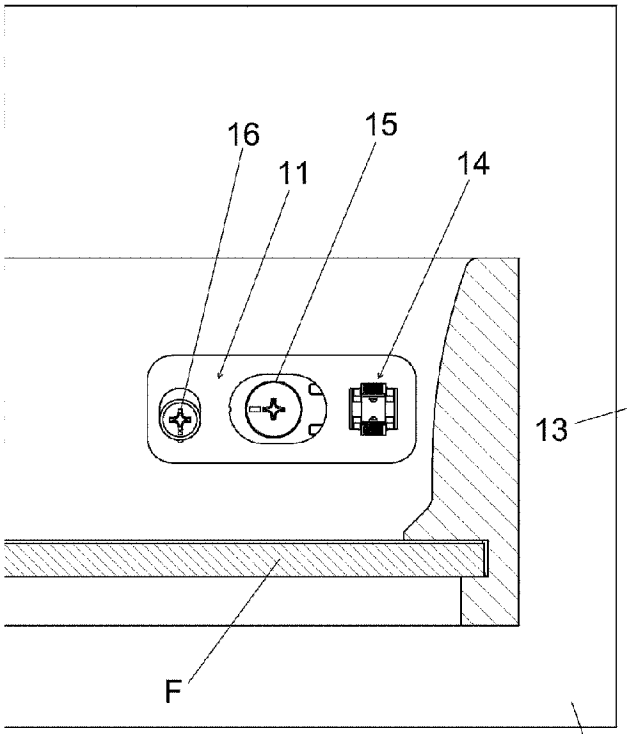

As shown in FIGS. 5, 5A, 5B, 6, 6A, and 6B, the rotation of said eccentric screw (15) causes the upward or downward sliding of the cursor (13) with respect to the first plate (12)—see FIGS. 5B, 6B—and of the teeth (133) inside the corresponding vertical slots (122).

According to the attached drawings, the apparatus of the invention advantageously comprises two first locking-regulating devices (1).

The assembly of each of said two first devices (1) provides for:

- fixing the first bracket (11) to the front edge (S) of the drawer (C);
- making the cursor (13) adhere to the first plate (12) in order to make said vertical guide means (122,133) cooperate;
- inserting the eccentric screw (15) into the pair of holes (12*b*, 13*a*);
- inserting the stem (16*a*) of the regulation screw (16) inside the hole (12*a*) obtained on the plate (12);
- fixing the cursor (13) on the back of the door (A), preferably with screws (V);
- inserting the teeth (14*b*) of the spring clip (14) into the rectangular slot (11*a*) and simultaneously the head (16*b*) of the regulation screw (16) into the vertical slot (112).

Figure 3:
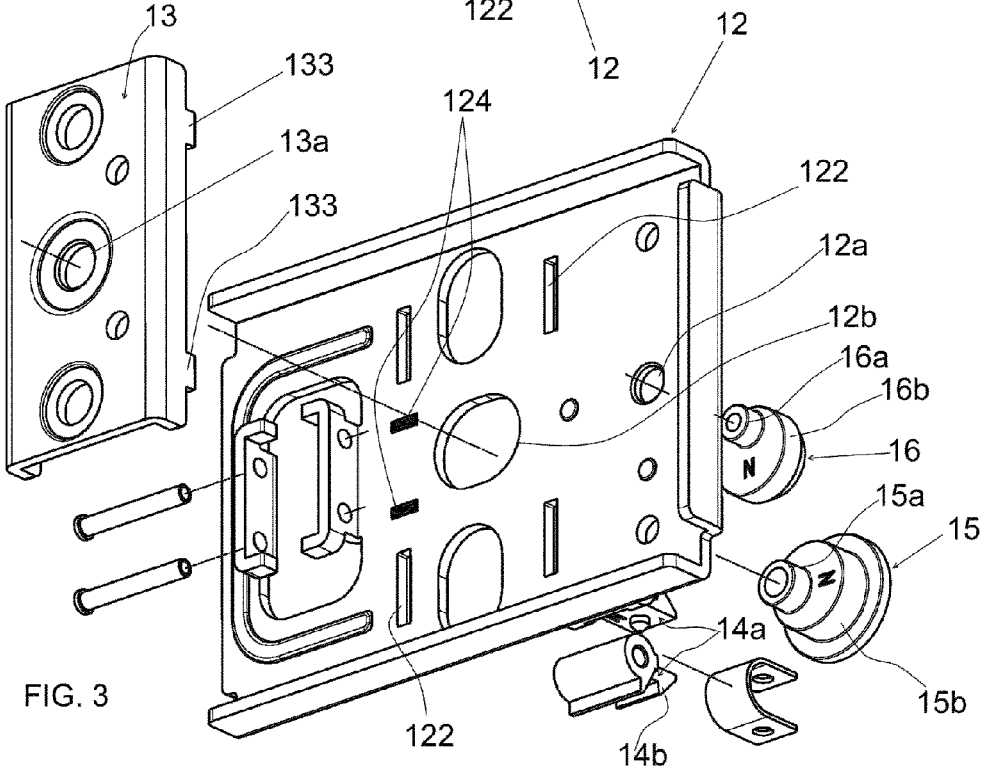

Referring to FIGS. 3 and 4, the plate (12) and cursor (13) comprise means (134,124) adapted to prevent free mutual sliding according to "Y" vertical axis.

Said means consist in knurls (124,134) provided on the surfaces of plate (12) and cursor (13) adapted to be in contact when the device (1) is assembled in operating condition.

After assembling the front door (A) on the drawer (C), it is necessary to regulate its position.

Regulation according to "X" axis is made by means of the head (16*a*) of the regulation screw (16), as shown in FIGS. 7, 7A, 7B, 8, 8A, and 8B.

Figure 7B:
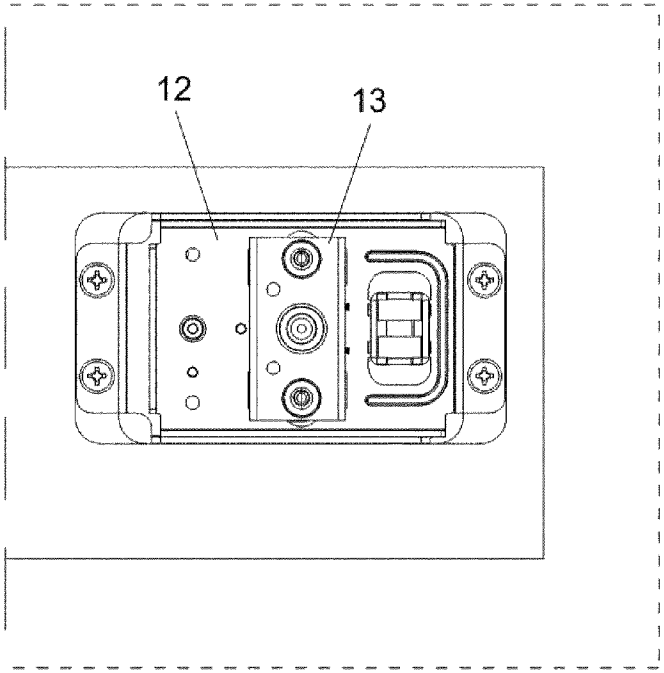
FIGS. 7 and 7B show the locking-regulating device mounted on the drawer of the invention, respectively seen from the inside and the outside, with front door completely moved to a lateral end-of-travel position.
Figure 7:
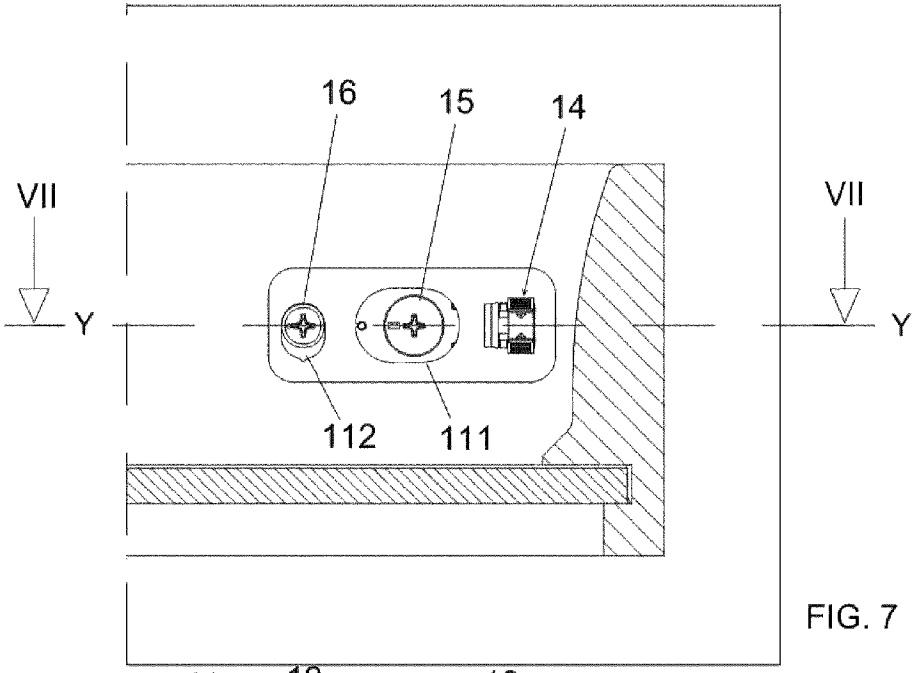
Figure 7A:
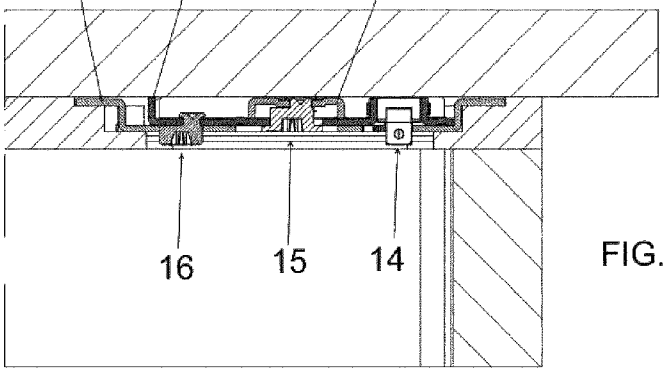
FIG. 7A is a sectional view of FIG. 7B with plane VII-VII.
Figure 8B:
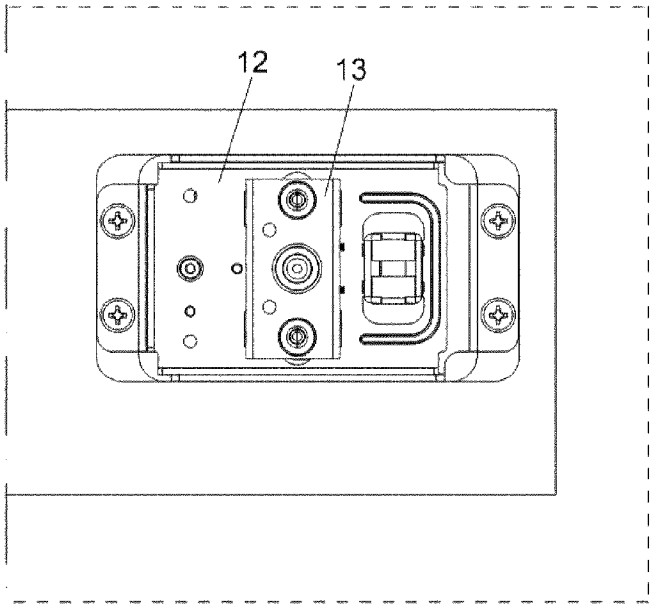
FIGS. 8 and 8B show the locking-regulating device mounted on the drawer of the invention, respectively seen from the inside and the outside, with front door completely moved to the lateral end-of-travel position opposite to the one of FIGS. 7, 7A, 7B.
Figure 8:
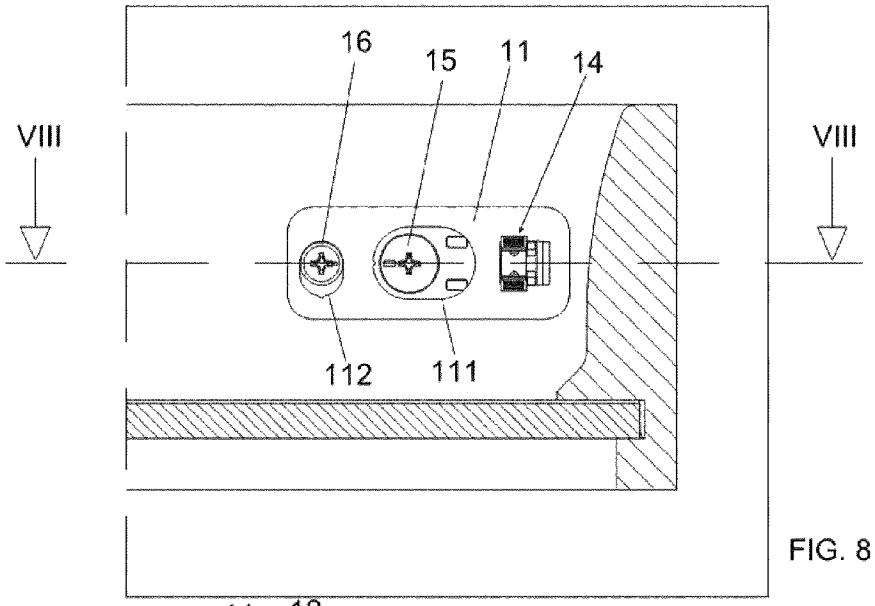
Figure 8A:
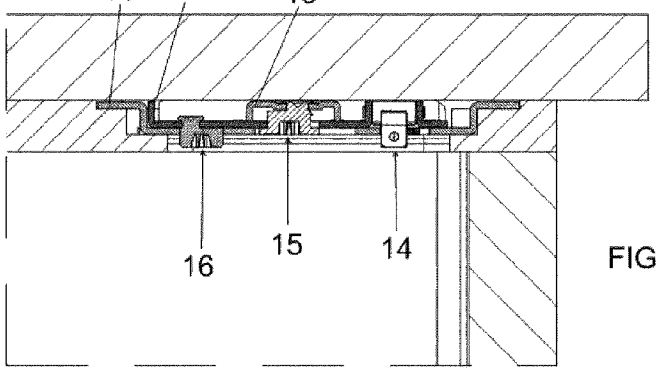
FIG. 8A is a sectional view of FIG. 8B with plane VIII-VIII.

By rotating the head (16*a*) the door (A) is moved rightwards or leftwards, with consequent sliding of the screw (15) inside the horizontal slot (111) and of the spring clip (14) inside the rectangular slot (11*a*), as shown in FIGS. 7 and 8.

Regulation of the front door (A) according to "Y" axis is made by means of the eccentric screw (15) in order to make cursor (13) slide with respect to the first plate (12).

As mentioned earlier, referring to FIGS. 5, 5A, 5B, 6, 6A, and 6B, the rotation of the eccentric screw (15) results in the mutual movement of the cursor (13) with respect to the first plate (12) according to "Y" axis; being the cursor (13) fixed to the front door (A) and the first plate (12) fixed by means of the spring clip (14) to the first bracket (11)—which is joined with the front edge (S) of the drawer (C)—said mutual movement according to "Y" axis between cursor (13) and plate (12) is translated in the movement of the front door (A) with respect to the drawer (C).

Referring to FIG. 1, the front edge (S) of the drawer (C) is finally provided with a window (51) through which said regulation means (15,16) of the door (A) can be actuated without having to remove it from the drawer (C).

Moreover, it must be noted that said screw (15) can be actuated from inside the drawer (C) because said bracket (11)

is provided with a horizontal slot (111) that houses the enlarged head (15*b*) of the screw (15), as shown in FIGS. 4, 5, 6, 7 and 8.

FIG. 4 also shows two caps (T) adapted to cover the two windows (Si) from inside the drawer (C), after selecting the correct position of the door (A) by means of the eccentric screw (15) and the regulation screw (16).

All attached drawings illustrate a drawer (C) provided with a niche (N) on the front edge (S) that completely houses said locking-regulation device (1).

The invention claimed is:

1. A drawer comprising:
a front vertical edge;
a front door; and
a locking-regulating apparatus adapted to regulate said front door with respect to said front vertical edge, said locking-regulating apparatus comprising:
a first bracket frontally fixed to said front vertical edge;
a cursor fixed on a back of said front door;
a plate fixed to said first bracket by a latch;
a vertical guide positioned between said plate and said cursor; and
a regulator along an X axis, said regulator comprising:
a regulation screw having a stem and an eccentric enlarged head;
a hole formed on said plate, said hole receiving said stem of said regulation screw; and
a vertical slot formed on said first bracket, said vertical slot receiving said eccentric enlarged head of said regulation screw.

2. The drawer of claim 1, said latch comprising:
a spring clip having a pair of wings with two retention teeth facing outwardly from opposite sides thereof; and
a rectangular slot formed on said first bracket, said spring clip fitted to said rectangular slot.

3. The drawer of claim 2, said rectangular slots having an upper edge and a lower edge, each of said upper edge and said lower edge having a knurled profile so as to increase a grip between said upper and lower edges and an external surface of said pair of wings.

4. The drawer of claim 1, said cursor and said plate cooperative with said regulator along a Y-axis.

5. The drawer of claim 4, said regulator along a Y-axis comprising:
an eccentric screw having a stem and an eccentric enlarged head;
a through hole formed on said cursor, said stem of said eccentric screw inserted into said through hole; and
a hole formed on said plate, said hole of said plate receiving said eccentric enlarged head of said eccentric screw.

6. The drawer of claim 5, said bracket having a horizontal slot that receives said eccentric enlarged head of said screw, said bracket being activated from inside the drawer.

7. The drawer of claim 1, said vertical guide comprising:
a plurality of vertical slots formed on said plate; and
a plurality of teeth affixed to said cursor, said plurality of teeth received inside said plurality of slots so as to slide along a vertical axis.

8. The drawer of claim 1, said front vertical edge having a first window that corresponds to said first bracket so as to allow for an activation of said regulation of said locking-regulating apparatus.

9. The drawer of claim 1, said front vertical edge having a niche completely housing said locking-regulating apparatus.

10. A drawer comprising:
a front vertical edge;
a front door; and
a locking-regulating apparatus adapted to regulate said front door with respect to said front vertical edge, said locking-regulating apparatus comprising:
a first bracket frontally fixed to said front vertical edge;
a cursor fixed on a back of said front door;
a plate fixed to said first bracket by a latch;
a vertical guide positioned between said plate and said cursor, said latch comprising:
a spring clip having a pair of wings with two retention teeth facing outwardly from opposite sides thereof; and
a rectangular slot formed on said first bracket, said spring clip fitted to said rectangular slot.

11. A drawer comprising:
a front vertical edge;
a front door; and
a locking-regulating apparatus adapted to regulate said front door with respect to said front vertical edge, said locking-regulating apparatus comprising:
a first bracket frontally fixed to said front vertical edge;
a cursor fixed on a back of said front door;
a plate fixed to said first bracket by a latch;
a vertical guide positioned between said plate and said cursor, said vertical guide comprising:
a plurality of vertical slots formed on said plate; and
a plurality of teeth affixed to said cursor, said plurality of teeth received inside said plurality of slots so as to slide along a vertical axis.

* * * * *